US007384111B2

(12) United States Patent
Hosono

(10) Patent No.: US 7,384,111 B2
(45) Date of Patent: Jun. 10, 2008

(54) LIQUID EJECTION APPARATUS AND METHOD OF CONTROLLING THE SAME

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 234 days.

(21) Appl. No.: 10/814,588

(22) Filed: Apr. 1, 2004

(65) Prior Publication Data

US 2004/0257391 A1 Dec. 23, 2004

(30) Foreign Application Priority Data

Apr. 1, 2003 (JP) ..... P2003-097671

(51) Int. Cl.
*B41J 29/38* (2006.01)

(52) U.S. Cl. ..... 347/11; 347/10

(58) Field of Classification Search ..... 347/10, 347/11

See application file for complete search history.

(56) References Cited

U.S. PATENT DOCUMENTS

| | | | | |
|---|---|---|---|---|
| 6,419,337 | B2 * | 7/2002 | Sayama | 347/11 |
| 6,619,777 | B2 * | 9/2003 | Chang | 347/10 |
| 6,679,586 | B2 * | 1/2004 | Kobayashi et al. | 347/55 |
| 6,726,299 | B2 | 4/2004 | Takahashi et al. | |
| 6,984,010 | B2 * | 1/2006 | Hosono et al. | 347/19 |
| 2004/0017413 | A1 * | 1/2004 | Kusunoki | 347/11 |
| 2004/0056909 | A1 * | 3/2004 | Takahashi et al. | 347/5 |
| 2004/0090476 | A1 * | 5/2004 | Sekiguchi | 347/11 |

FOREIGN PATENT DOCUMENTS

| | | | |
|---|---|---|---|
| JP | 09-226116 | A | 9/1997 |
| JP | 10-81013 | A | 3/1998 |
| JP | 2000-280475 | A | 10/2000 |
| JP | 2001-080071 | A | 3/2001 |
| JP | 2001-121722 | A | 5/2001 |
| JP | 2001-277493 | A | 10/2001 |
| JP | 2001-301163 | A | 10/2001 |
| JP | 2002-103617 | A | 4/2002 |
| JP | 2002-113858 | A | 4/2002 |

* cited by examiner

*Primary Examiner*—Julian D. Huffman
*Assistant Examiner*—Jason S Uhlenhake
(74) *Attorney, Agent, or Firm*—Sughrue Mion, PLLC

(57) ABSTRACT

A liquid ejection head includes a nozzle orifice communicated with a pressure chamber, and a pressure generating element. A drive signal generator generates a drive signal containing, within one cycle thereof, a first drive subsignal containing first drive pulses driving the pressure generating element so as to eject the liquid, and a second drive pulse driving the pressure generating element so as not to eject the liquid, and at least one second drive subsignal containing the first drive pulses without containing the second drive pulse. A pulse supplier selectively supplies at least one of the first drive pulses and the second drive pulse to the pressure generating element, in accordance with an amount of the liquid to be ejected. Each of the first drive subsignal and the second drive subsignal is associated with a minimum area subjected to the liquid ejection.

13 Claims, 10 Drawing Sheets

| PRINT DATA | t1 | t2 | t3 | t4 | DECODED VALUE | |
|---|---|---|---|---|---|---|
| 1 (00) | O | X | X | X | 1000 | |
| 2 (01) | X | X | O | X | 0010 | SMALL DOT |
| 3 (10) | X | O | X | X | 0100 | MEDIUM DOT |
| 4 (11) | X | O | X | O | 0101 | LARGE DOT |

| PRINT DATA | t1' | t2 | t3 | t4 | DECODED VALUE | |
|---|---|---|---|---|---|---|
| 1 (00) | O | X | X | X | 1000 | VIBRATING |
| 2 (01) | X | X | O | X | 0010 | SMALL DOT |
| 3 (10) | X | O | X | X | 0100 | MEDIUM DOT |
| 4 (11) | X | O | X | O | 0101 | LARGE DOT |

| PRINT DATA | t1 | t2 | t3 | t4 | DECODED VALUE | |
|---|---|---|---|---|---|---|
| 1 (00) | ○ | × | × | × | 1000 | |
| 2 (01) | × | × | ○ | × | 0010 | SMALL DOT |
| 3 (10) | × | ○ | × | × | 0100 | MEDIUM DOT |
| 4 (11) | × | ○ | × | ○ | 0101 | LARGE DOT |

| PRINT DATA | t1' | t2 | t3 | t4 | DECODED VALUE | |
|---|---|---|---|---|---|---|
| 1 (00) | ○ | × | × | × | 1000 | VIBRATING |
| 2 (01) | × | × | ○ | × | 0010 | SMALL DOT |
| 3 (10) | × | ○ | × | × | 0100 | MEDIUM DOT |
| 4 (11) | × | ○ | × | ○ | 0101 | LARGE DOT |

| PRINT DATA | ta | tb | tc | td | DECODED VALUE | |
|---|---|---|---|---|---|---|
| 1 (00) | ○ | × | × | × | 1000 | VIBRATING |
| 2 (01) | × | × | ○ | × | 0010 | SMALL DOT |
| 3 (10) | × | ○ | × | × | 0100 | MEDIUM DOT |
| 4 (11) | × | ○ | × | ○ | 0101 | LARGE DOT |

LIQUID EJECTION APPARATUS AND METHOD OF CONTROLLING THE SAME

BACKGROUND OF THE INVENTION

The present invention relates to a liquid ejection apparatus for ejecting liquid as liquid drops from nozzle orifices and a method of controlling such an apparatus. More particularly, the invention relates to a liquid ejection apparatus capable of preventing the viscosity of the liquid from increasing by finely vibrating the meniscus of liquid in the nozzle orifice.

An image recording apparatus such as a printer, plotter, or the like is available as one kind of liquid ejection apparatus capable of ejecting liquid in the state of liquid drops. In this image recording apparatus, liquid ink is ejected from an ejection head and made to land on a recording medium such as paper. Thus, characters and images are recorded. Furthermore, recently, by making use of the characteristics permitting an extremely small amount of liquid to land on the medium accurately, application to various apparatus has been discussed. For example, display fabrication equipment for fabricating color filters such as for liquid crystal displays, electrode fabrication equipment for forming electrodes such as organic electroluminescent displays and FEDs (field emission displays), and chip fabrication equipment for fabricating biochips (biochemical devices) have been proposed.

In this kind of liquid ejection apparatus, the ejected liquid is exposed at the nozzle orifices and forms a meniscus (free surface of liquid). Through this meniscus, evaporation of the solvent component occurs, and the viscosity of the liquid may increase in the vicinities of the nozzle orifices. In an attempt to prevent this viscosity increase, the meniscus is vibrated finely to such an extent that liquid drops are not be ejected and the liquid is stirred. Such a vibrating operation is performed during the period in which liquid drops can be ejected. For example, as is disclosed in Japanese Patent Publication No. 10-81013A, a vibrating pulse is contained in a signal for driving a pressure generating element, and the vibrating operation is performed by selectively supplying the vibrating pulse to the pressure generating element.

In this case, a drive signal generator generates a series of drive signal in response to reception of a trigger signal. For example, as shown in FIG. 10, in an ink jet printer that is one kind of liquid ejection apparatus, a series of drive signal COM is generated over a signal generation period T when a trigger signal PTS is received, in order to accurately define the landing positions of liquid drops. Specifically, the aforementioned trigger signal is created by multiplying (increasing the frequency several-fold) the output from a linear encoder indicative of the carriage position. As a consequence, the deviation between the scan position of the recording head and the signal generation timing can be reduced as less as possible. The accuracy of the landing positions can be accordingly enhanced. Furthermore, in the above printer, a trigger signal PTS is generated every time when the printing for a 1-dot area (pixel) is performed.

Incidentally, this kind of liquid ejection apparatus is required of high-frequency ejection of liquid drops since the processing speed can be increased and the landing density can be improved. For example, in an ink jet printer, if the ejection frequency of ink drops can be increased, the scanning speed of the recording head can be increased accordingly, while maintaining the image resolution (quality). In other words, the image resolution can be enhanced while maintaining the scanning speed of the recording head unchanged.

In order to attain high-frequency ejection of liquid drops, it is necessary to shorten the interval at which ejection pulses are generated regarding the ejection pulses for ejecting the liquid drops. However, the above-described vibrating pulse is used only to vibrate the meniscus and does not involve ejection of the liquid drops. Therefore, in the configuration where a vibrating pulse is contained within each ejection period, a time for the vibrating pulse is necessary. Accordingly, the ejection interval of the liquid drops is prolonged by an amount corresponding to the vibrating pulse. This creates an impediment to high-frequency ejection of liquid drops.

Furthermore, the degree of necessity of the vibrating operation varies according to the kind of the ejected liquid. That is, some liquids need frequent vibration in non-ejection periods, while others do not. Therefore, performing the operation impartially regardless of the kind of liquid is not efficient.

SUMMARY OF THE INVENTION

It is therefore an object of the invention to provide a liquid ejection apparatus capable of ejecting liquid drops at a higher frequency.

It is also an object of the invention to provide a method of controlling such an apparatus.

In order to achieve the above objects, according to the invention, there is provided a liquid ejection apparatus, comprising:

- a liquid ejection head, comprising:
  - a nozzle orifice communicated with a pressure chamber; and
  - a pressure generating element, which generates pressure fluctuation in liquid which is contained in the pressure chamber;
- a drive signal generator, which generates a drive signal containing, within one cycle thereof:
  - a first drive subsignal, containing a plurality of first drive pulses each of which drives the pressure generating element to generate the pressure fluctuation so as to eject the liquid from the nozzle orifice, and a second drive pulse which drives the pressure generating element to generate the pressure fluctuation so as not to eject the liquid from the nozzle orifice; and
  - at least one second drive subsignal, containing only the first drive pulses; and
- a pulse supplier, which selectively supplies at least one of the first drive pulses and the second drive pulse to the pressure generating element, in accordance with an amount of the liquid to be ejected from the nozzle orifice,
- wherein each of the first drive subsignal and the second drive subsignal is associated with a minimum area subjected to the liquid ejection.

Here, all of the first drive pulses have an identical waveform.

In such configurations, since the second drive subsignal contains no second drive pulse, the duration of the second drive subsignal can be made shorter than the first drive subsignal by an amount corresponding to the absence of the second pulse. Thus, the duration of the drive signal can be made shorter even though the necessary meniscus vibration is secured. As a result, high-frequency ejection of liquid drops can be accomplished.

Furthermore, the frequency of the meniscus vibration can be adjusted by changing the number of the second drive subsignal contained in the one cycle of the drive signal. As a result, the meniscus vibration can be optimized in accordance with the kind of liquid.

Preferably, the second drive subsignal is arranged at the beginning of the one cycle of the drive signal.

In such a configuration, the effect of the meniscus vibration can be enhanced.

Preferably, each of the first drive pulses and the second pulse is designated by one of pulse selection data processed in the pulse supplier. The number of the pulse selection data for the first drive subsignal and the number of the pulse selection data for the second drive subsignal are the same, so that a predetermined potential of the second drive subsignal is supplied to the pressure generating element by one of the pulse selection data for the second drive subsignal.

In such a configuration, the pulse selection data for the first drive subsignal and the pulse selection data for the second drive subsignal can be treated similarly. The processing can be simplified. This is adapted for high-speed processing.

Preferably, the drive signal is repetitively generated in accordance with a series of first timing signals which are generated in the external of the drive signal generator. A duration of the one cycle of the drive signal is less than an interval of the first timing signals.

Here, it is preferable that the minimum area is repetitively defined in accordance with a series of second timing signals which are generated in the external of the drive signal generator. A duration of each of the first drive subsignal and the second drive subsignal is less than an interval of the second timing signals.

In such configurations, it is possible to avoid such an anxiety that the drive signal or the subsignal is not completed until the next timing signal comes.

Preferably, the first drive pulses includes a pair of first ejection pulses each for ejecting a liquid droplet having a first volume, and a second ejection pulse generated between the first ejection pulses for ejecting a liquid droplet having a second volume less than the first volume.

Alternatively, it is preferable that the first drive pulses are generated at a fixed interval each for ejecting a liquid droplet having a fixed volume.

According to the invention, there is also provided a method of controlling a liquid ejection apparatus which comprises a liquid ejection head provided with: a nozzle orifice communicated with a pressure chamber; and a pressure generating element, which generates pressure fluctuation in liquid which is contained in the pressure chamber, the method comprising steps of:

generating a drive signal containing, within one cycle thereof:

a first drive subsignal, containing a plurality of first drive pulses each of which drives the pressure generating element to generate the pressure fluctuation so as to eject the liquid from the nozzle orifice, and a second drive pulse which drives the pressure generating element to generate the pressure fluctuation so as not to eject the liquid from the nozzle orifice; and at least one second drive subsignal, containing only the first drive pulses; and supplying selectively at least one of the first drive pulses and the second drive pulse to the pressure generating element, in accordance with an amount of the liquid to be ejected from the nozzle orifice, wherein each of the first drive subsignal and the second drive subsignal is associated with a minimum area subjected to the liquid ejection.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the present invention will be described based on the accompanying drawings. In the following description, an image recording apparatus that is one kind of liquid ejection apparatus, or more specifically an ink jet printer (hereinafter referred to as the printer), is taken as an example.

Figure 1:
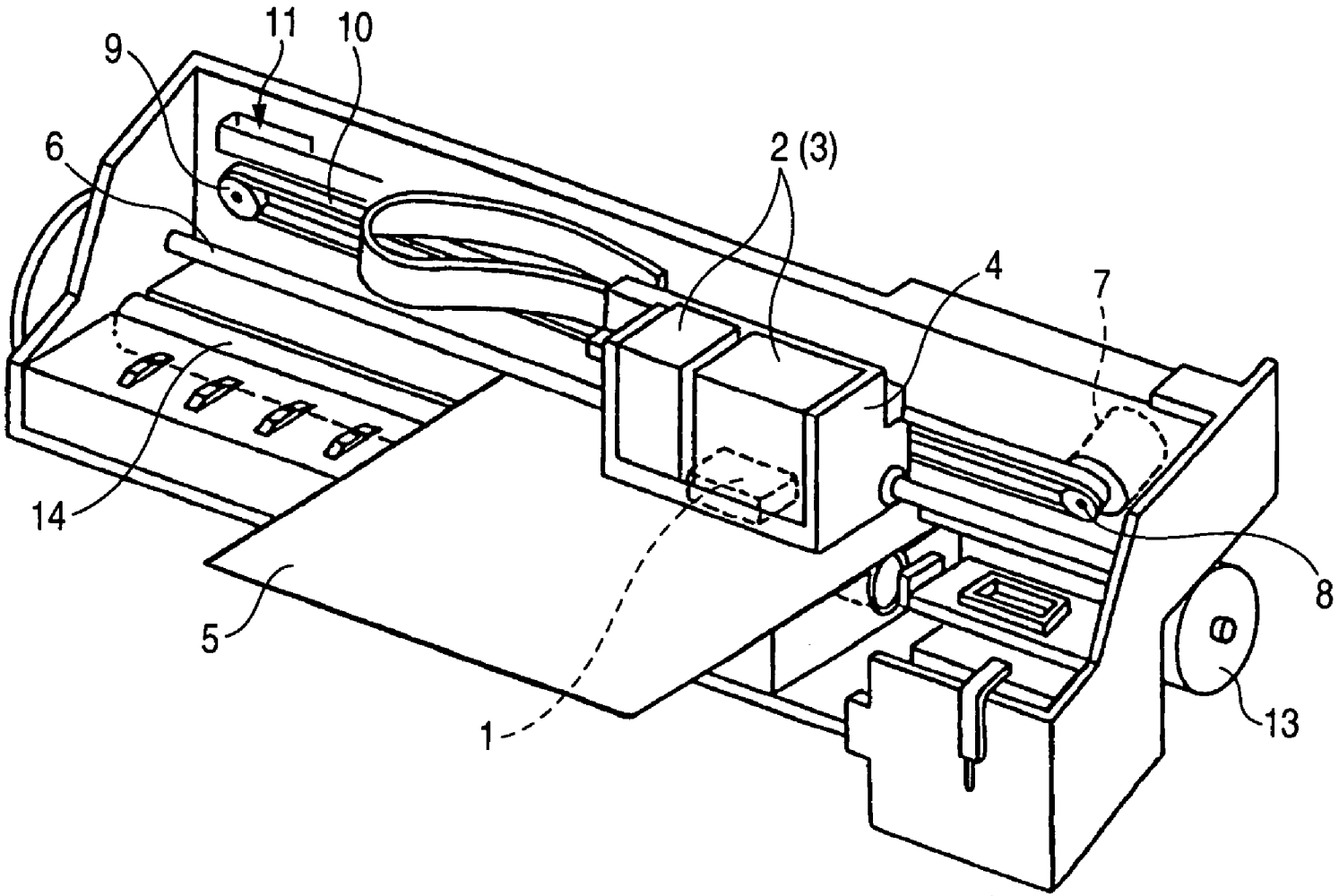
FIG. 1 is a perspective view an ink jet printer.

As shown in this FIG. 1, a recording head 1 (liquid ejection head) is mounted on the printer. The printer comprises: a carriage 4 having a cartridge holder 3 for holding an ink cartridge 2 detachably; a head scanning mechanism for reciprocating the carriage 4 in the lateral direction (primary scanning direction) of recording paper 5; and a paper feeding mechanism for moving the recording paper 5 in the paper feeding direction (secondary scanning direction).

The head scanning mechanism comprises: a guide shaft 6 mounted to extend in the lateral direction of the paper; a pulse motor 7 disposed at one side of the printer in the primary scanning direction; a drive pulley 8 connected with the rotating shaft of the pulse motor 7 and rotationally driven by the pulse motor 7; an idler pulley 9 disposed on the other side in the primary scanning direction on the opposite side of the drive pulley 8; a timing belt 10 suspended between the drive pulley 8 and the idler pulley 9 and connected with the carriage 4; a linear encoder 11 for outputting positional information of the carriage 4 (recording head 1); and a controller 12 (see FIG. 6) for controlling the rotation of the pulse motor 7. Furthermore, the paper feeding mechanism is composed of a paper feeding motor 13 acting as a driver source, a paper feeding roller 14 rotationally driven by the paper feeding motor 13, and the controller 12 controlling the operation of the paper feeding motor 13.

Figure 2:
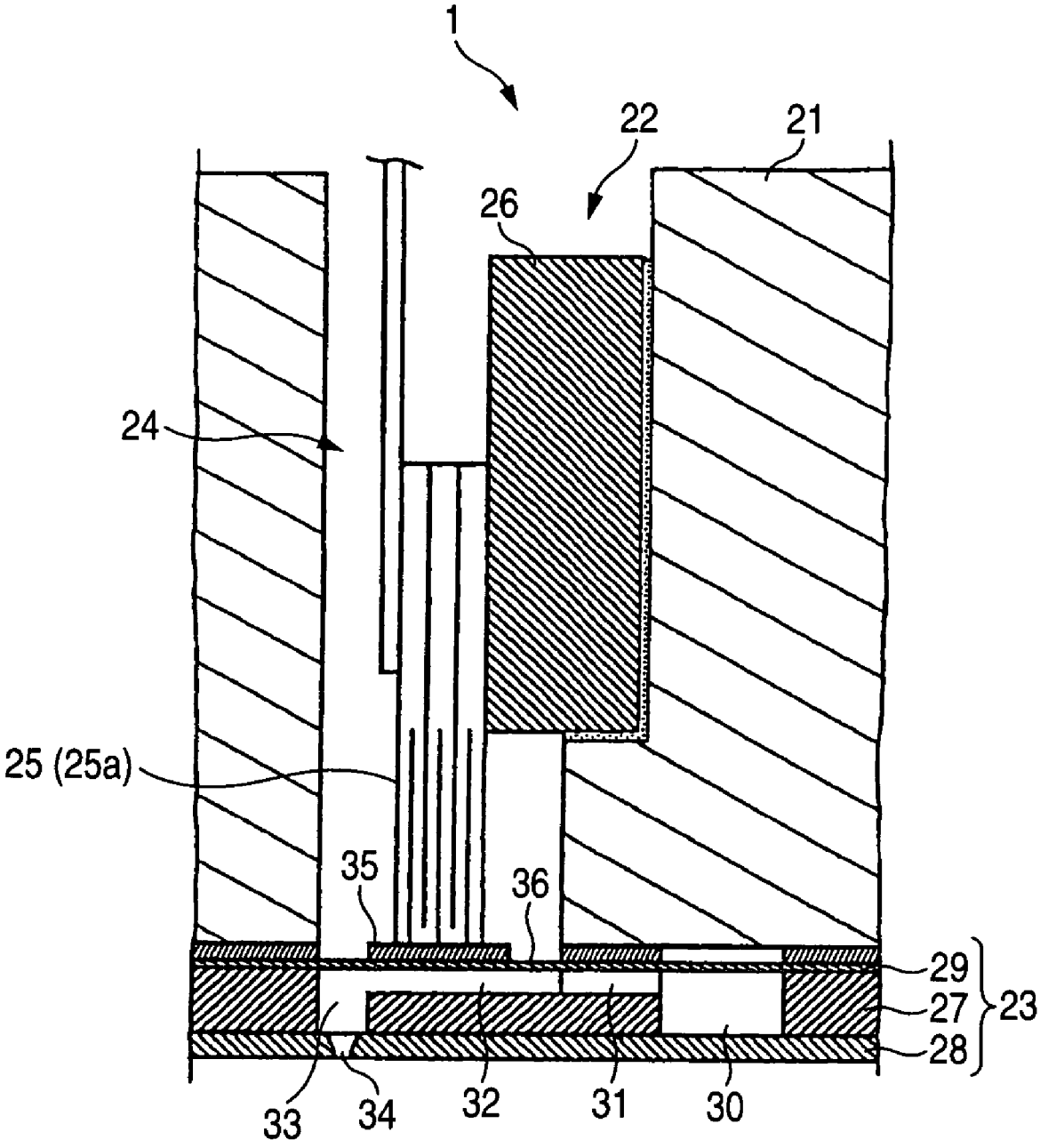
FIG. 2 is a cross-sectional view showing the structure of a recording head in the ink jet printer of FIG. 1.

The recording head 1 roughly consists of: a case 21; an actuator unit 22 accommodated in this case 21; a flow passage unit 23 joined to the front end face of the case 21 as shown in FIG. 2. The case 21 is a block-shaped member molded from a thermosetting resin such as an epoxy-based resin. The case 21 is provided with an actuator chamber 24 capable of accommodating the actuator unit 22. The actuator unit 22 has an actuator array 25 consisting of pectinated piezoelectric actuators 25*a*, a fixation plate 26 to which the actuator array 25 is bonded so as to be supported thereon in a cantilevered manner. Each of free ends of the piezoelectric actuators 25*a* is extended or shrunk in the longitudinal direction thereof in accordance with the electric potential applied thereto.

The flow passage unit 23 is so configured that a nozzle plate 28 is joined to one surface of a flow passage formation substrate 27, and that a resilient plate 29 is joined to the other surface thereof the flow passage formation substrate 27. This flow passage unit 23 is provided with a common ink reservoir 30, ink supply ports 31, pressure chambers 32, nozzle communication ports 33, and nozzle orifices 34. An ink flow passage is formed so as to communicate each of the nozzle orifices 34 and the common ink reservoir 30 via the associated one of the ink supply ports 31, the associated one of the pressure chambers 32 and the associated one of the nozzle communication ports 33.

The resilient plate 29 is formed with a diaphragm portion. This diaphragm portion is a portion partitioning a part of the pressure chamber 32, and has island portions (thick-walled portions) 35 to which the front end faces of the piezoelectric actuator 25*a* are joined and thin-walled portions 36 having resilience and formed around the island portions 35. When the piezoelectric actuator 25*a* is extended, the island portion 35 is pushed toward the pressure chamber 32. This displacement of the island portion 35 reduces the volume of the pressure chamber 32. Meanwhile, when the piezoelectric actuator 25*a* is shrunk, the island portion 35 is pulled away from the pressure chamber 32. This displacement of the island portion 35 increases the volume of the pressure chamber 32.

As the volume of the pressure chamber 32 varies in this way, the pressure of the ink in the pressure chamber 32 varies. Therefore, ink drops can be ejected from the nozzle orifices 34 by controlling this pressure variation. For example, ink drops can be ejected by shrinking and then extending the piezoelectric actuator 25*a*. In this case, shrinkage of the piezoelectric actuator 25*a* expands the pressure chamber 32, causing the ink stored in the reservoir 30 to flow into the pressure chamber 32. Subsequently, the rapid extension of the piezoelectric actuator 25*a* rapidly contracts the pressure chamber 32, applying pressure to the ink inside the pressure chamber 32. Therefore, ink drops are ejected from the associated nozzle orifice 34.

The amount of ejected ink drops can be varied by varying the pressure variation pattern applied to the ink inside the pressure chamber 32. Also, the meniscus can be vibrated finely.

The linear encoder 11 has a scale 41 (see FIGS. 3 and 4) extending parallel to the primary scanning direction, and a photo interrupter 42 (see FIG. 5) mounted on the back face of the carriage 4.

Figure 3:
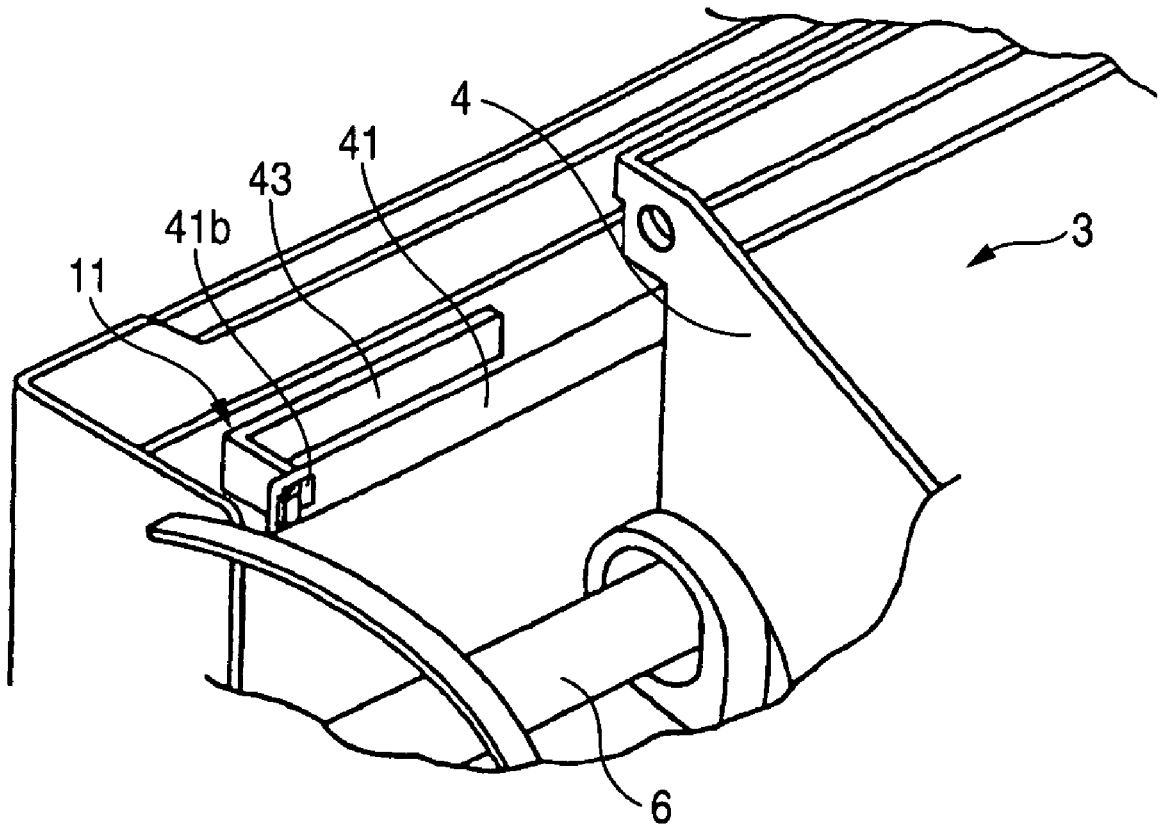
FIGS. 3 and 4 are enlarged perspective views of a linear encoder in the ink jet printer of FIG. 1.
Figure 4:
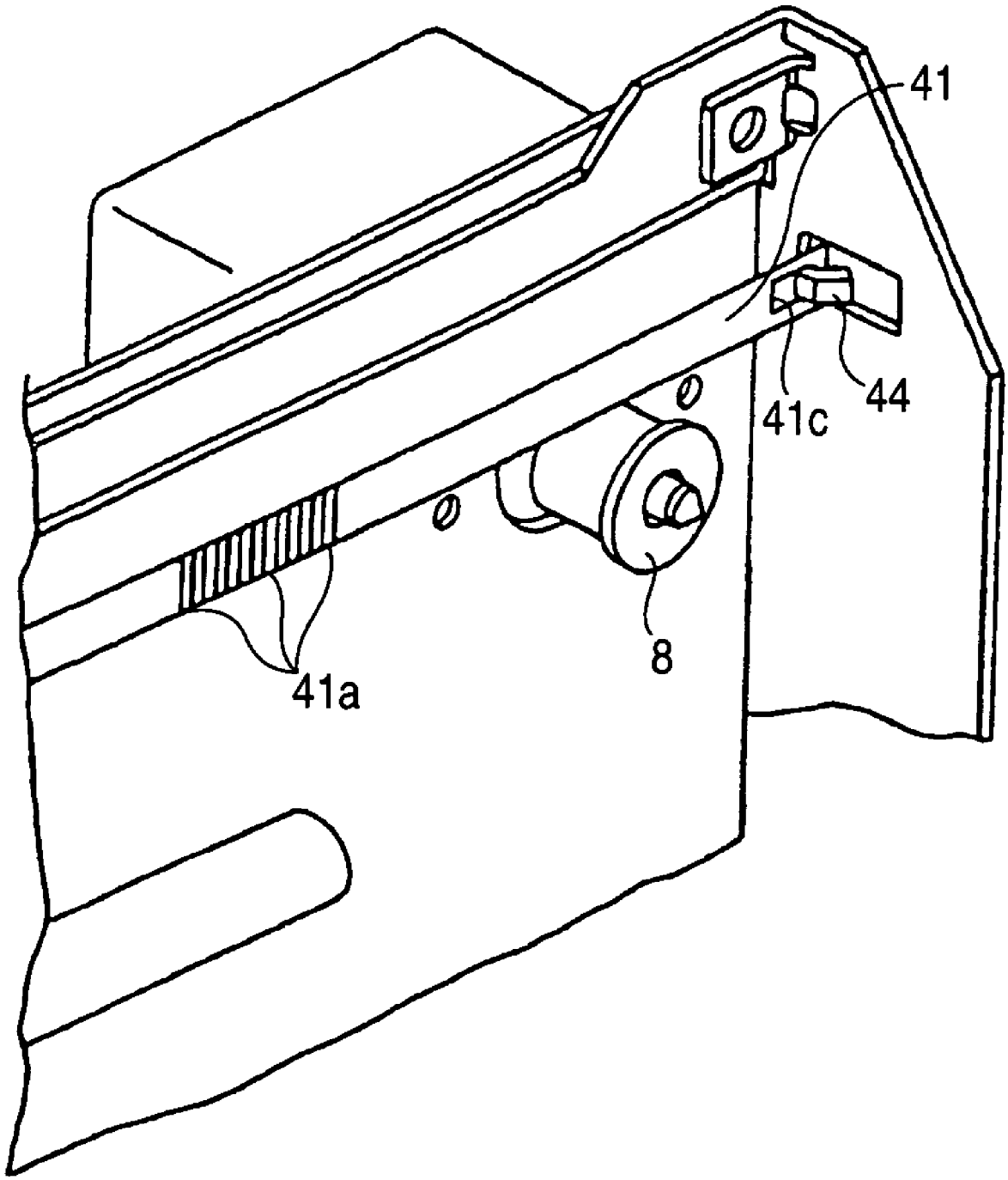
Figure 5:
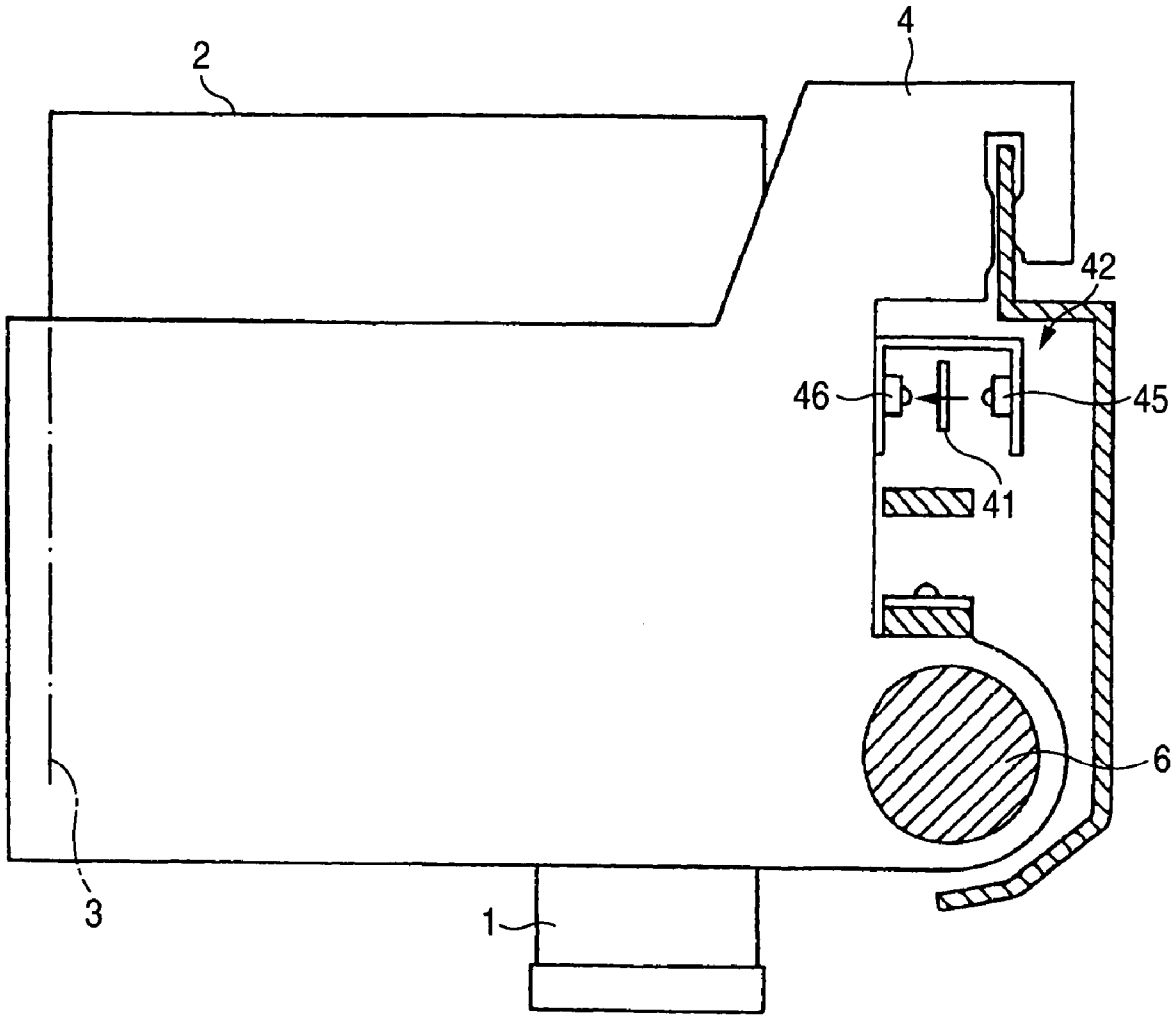
FIG. 5 is a section view showing the linear encoder.

The scale 41 is a belt-shaped (band-shaped) member fabricated from transparent resin. Plural black stripes 41*a* are formed at a given pitch in the longitudinal direction of the scale 41 so as to extend the width direction of the band. In the present embodiment, the stripes 41*a* are printed at a pitch corresponding to 180 dpi. Detent holes 41*b* and 41*c* are formed in both end portions of the scale 41. These detent holes 41*b* and 41*c* are engaged with their respective hooks. That is, one detent hole 41*b* is engaged with a first hook 43 that is mounted on the surface of the back plate of the casing body on the side of the idler pulley 9 as shown in FIG. 3. The resilience of the first hook 43 pulls the scale 41 outward in the longitudinal direction. The other detent hole 41*c* is engaged with a second hook 44 mounted on a side plate of the casing body on the side of the pulse motor 7 as shown in FIG. 4.

In the photo interrupter 42, a pair of a light emitter 45 and a light receiver 46 are mounted on the inner surface of a U-shaped frame 47 so as to oppose to each other. The scale 41 is disposed between the light emitter 45 and the light receiver 46. Therefore, the detection signal (encoder output) from the light receiver 46 generates an output that assumes a different level, depending on whether light from the light emitter 45 has passed through the scale 41 or the stripes 41*a* have blocked the light from the light emitter 45. This encoder output is input to the controller 12 as shown in FIG. 6.

Accordingly, in this linear encoder 11, when the carriage 4 (recording head 1) moves in the primary scanning direction, the stripes 41*a* intermittently block the light from the light emitter 45 and so the light emitter 46 generates a pulsed detection signal. Since the stripes 41*a* are formed at regular intervals, the controller 12 can recognize the scanning position of the carriage 4, based on the encoder output.

If an encoder output corresponding to movement of the carriage 4 is obtained, this linear encoder 11 is not limited to this configuration. For example, the scale 41 may be made of a light-shielding band members and light-transmitting slits may be formed at regular intervals.

Figure 6:
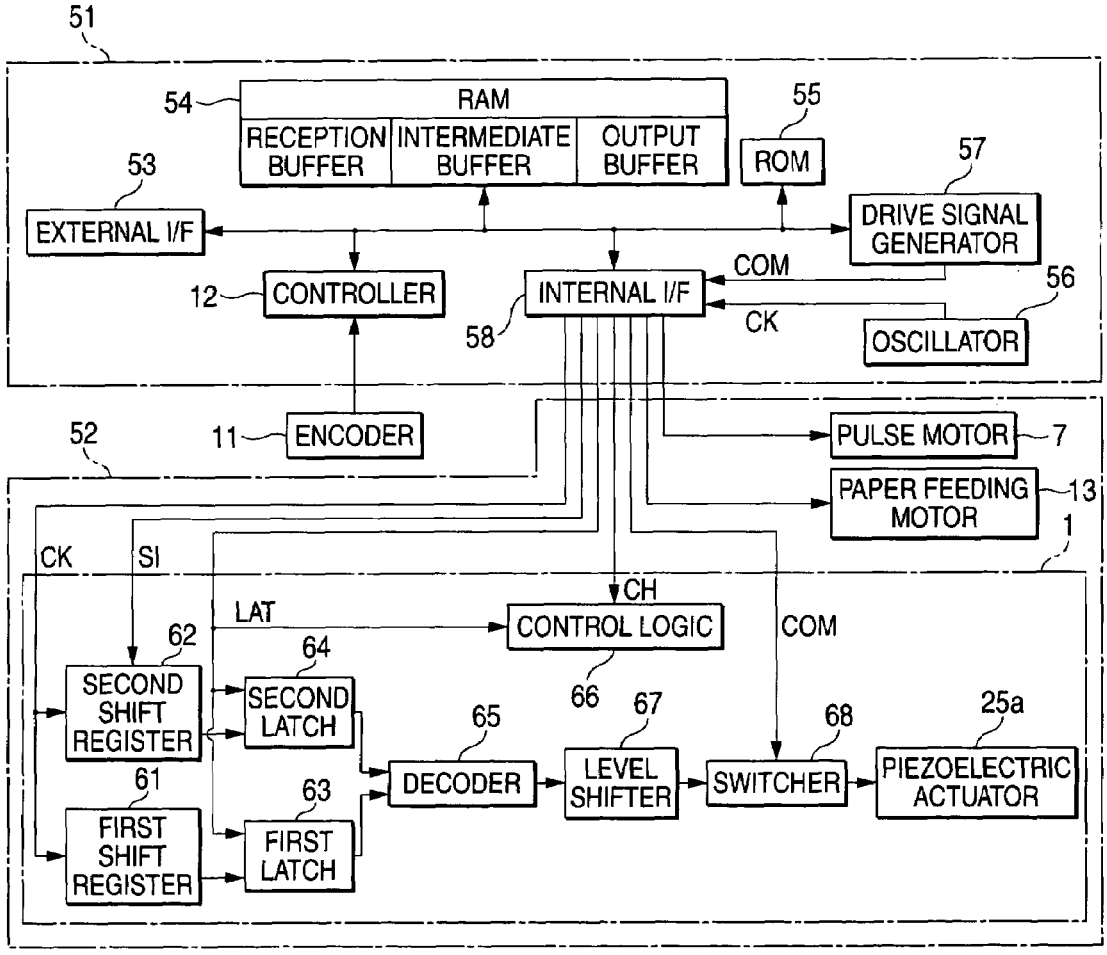
FIG. 6 is a block diagram showing the electrical configuration of the ink jet printer of FIG. 1.

The electrical configuration of the printer is next described based on the block diagram of FIG. 6. The exemplified printer comprises a printer controller 51 and a print engine 52. The printer controller 51 comprises: an interface (external I/F) 53 for receiving print data from a host computer (not shown); a RAM 54 for storing or processing various kinds of data; a ROM 55 in which a routine for various kinds of data processing are stored; the controller 12 consisting of a CPU or the like; an oscillator 56 producing a clock signal (CK); a drive signal generator 57 generating a drive signal (COM) to be supplied to the recording head 1; and an interface (internal I/F) 58 for transmitting ejection data (dot pattern data), the drive signal, and so on to the print engine 52.

The external I/F 53 receives print data consisting, for example, of one or more sets of data of character codes, graphic function, and image data from the host computer. Furthermore, the external I/F 53 outputs a busy signal (BUSY), acknowledge signal (ACK) to the host computer. The RAM 54 is used as a reception buffer, an intermediate buffer, an output buffer, a working memory (not shown), or the like. Print data that has been received by the external I/F 53 from the host computer is temporarily stored in the reception buffer. Intermediate code data converted by the controller 12 is stored in the intermediate buffer. Ejection data to be serially transmitted to the recording head 1 is obtained in the output buffer. Various kinds of control routines executed by the controller 12, font data, graphic functions, various procedures are stored in the ROM 55.

The controller 12 serves as a data converter to convert the print data into the ejection data. In this case, the controller 12 reads out the print data within the reception buffer, converts the data into intermediate code data, and stores the intermediate code data into the intermediate buffer. The controller 12 analyzes the intermediate code data read from the intermediate buffer and converts the intermediate code data into ejection data for each dot (pixel) by referring to font data, graphics function, or the like in the ROM 55. In the present embodiment, this ejection data is composed of 2-bit data. The obtained ejection data is stored in the output buffer. If one line of ejection data corresponding to one primary scanning is obtained, the 1 line of ejection data (SI) is serially transmitted to the recording head 1 through the internal I/F 58. When one line of ejection data is sent out from the output buffer, the contents of the intermediate buffer are erased, and a conversion into next intermediate code data is performed.

Furthermore, the controller 12 serves as a trigger signal generator for producing a trigger signal (PTS). The trigger signal referred to herein is a signal determining the timing at which the drive signal generated by the drive signal generator 57 start to be generated. That is, the drive signal generator 57 generates a series of drive signal over a signal generation period when the trigger signal is received. In the present embodiment, this trigger signal is output at an interval corresponding to 720 dpi. That is, the controller 12 multiplies the encoder output from the linear encoder 11 fourfold to thereby generate the trigger signal.

Moreover, the controller 12 serves also as a latch signal generator and as a selection timing signal generator, and outputs a latch signal (LAT) defining latch timing of ejection data and a channel signal (CH; selection timing signal) defining selection timing of pulses contained in the drive signal. A first latch signal is generated in response to reception of the trigger signal as described later. Then, under the condition of a lapse of a given time, a second latch signal is generated. Therefore, the controller 12 serves also as a timer for measuring the time elapsed from the generation of the first latch signal. In other words, the latch signal generator defines the generation timing of the second latch signal based on the generation timing of the first latch signal.

Figure 7:
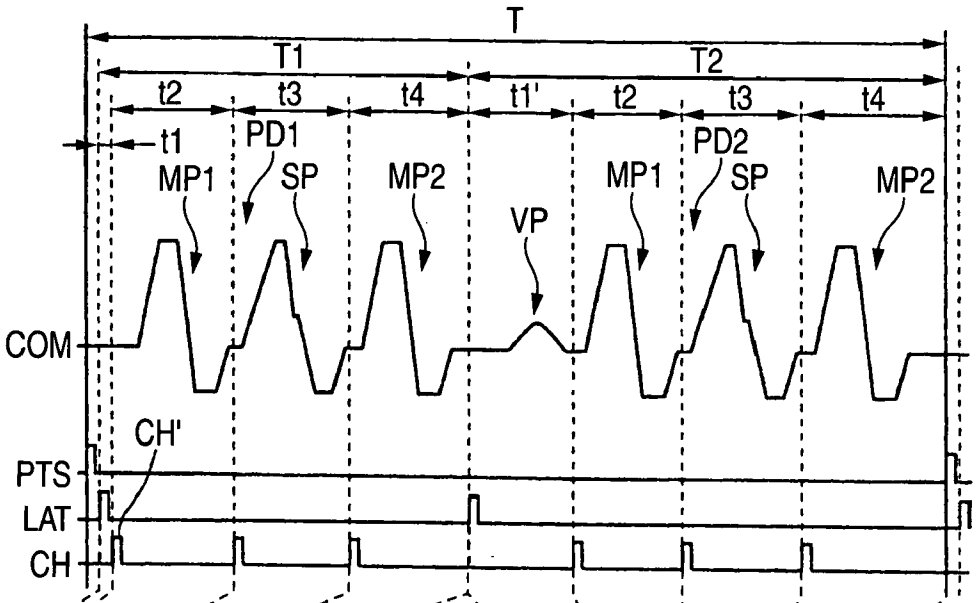
FIG. 7 is a diagram showing a drive signal for the recording head according to one embodiment of the invention.

As exemplified in FIG. 7, the drive signal generator 57 generates a drive signal (COM) including a plurality of ejection pulses (SP, MP1, MP2) and vibrating pulse (VP) over a signal generation period. The drive signal are described in detail later.

Furthermore, the drive signal generator 57 in the present embodiment is designed to gain variation amount information (information indicating the amount of variation of voltage) from the controller 12 at appropriate time and to incrementally add the gained variation amount information at quite short update intervals. At the instant of the end of the signal generation period, the variation amount information of value "0" is given from the controller 12. Therefore, during the period from the end instant of one signal generation period to the beginning instant of the next signal generation period, the control by the controller 12 is released but a constant signal is output at an intermediate potential Vm.

The print engine 52 is composed of the pulse motor 7 in the head scanning mechanism, the paper feeding motor 13 in the paper feeding mechanism, the recording head 1, and so on. The pulse motor 7 serves as a drive source for moving the recording head 1. That is, by operating the pulse motor 7, the recording head 1 is moved in the lateral direction of the recording paper 5 (i.e., in the primary scanning direction). Furthermore, the paper feeding motor 13 serves as a drive source for feeding the recording paper 5 in steps in the paper-feeding direction (i.e., in the secondary scanning direction). These pulse motor 7 and paper feeding motor 13 operate in an interlocking manner under control of the controller 12.

The electrical configuration of the recording head 1 is next described. The recording head 1 comprises: a shift register circuit consisting of first shift registers 61 and second shift registers 62; latch circuits consisting of first latches 63 and second latches 64; decoders 65; a control logic 66; level shifters 67; switchers 68; and piezoelectric actuators 25*a*. The shift registers 61, 62, latch circuits 63, 64, decoders 65, level shifters 67, switchers 68, and piezoelectric actuators 25*a* are associated with the respective nozzle orifices 34 in one by one correspondence.

This recording head 1 ejects ink drops based on the ejection data (SI) from the printer controller 51. This is described in detail below.

The ejection data from the printer controller 51 is serially transmitted to the first shift registers 61 and second shift registers 62 from the internal I/F 58 in synchronism with the dock signal (CK) from the oscillator 56. This ejection data is 2-bit data as described above. In the present embodiment, the data is composed of gradation information indicating four levels of recording gradation (ejection level) consisting of non-recording, small-dot recording, medium-dot recording, and large-dot recording. In particular, the non-recording is associated with gradation information "00". The small-dot recording is associated with gradation information "01". The medium-dot recording is associated with gradation information "10". The large-dot recording is associated with gradation information "11".

The ejection data is set for each nozzle orifice 34. Lower significant bit (L) data for all the nozzle orifices 34 are input to the first shift registers 61. Upper significant bit (H) data are input to the second shift registers 62. The first latches 63 are electrically connected with the first shift registers 61. The second latches 64 are electrically connected with the second shift registers 62. If a latch signal (LAT) from the printer controller 51 is entered into the latch circuits, the first latches 63 latch the lower significant bit data of the ejection data, while the second latches 64 latch the upper significant bit data of the ejection data. The set of the first shift registers 61 and first latches 63 and the set of the second shift registers 62 and second latches 64 operating in this way form memory devices which temporarily store the ejection data prior to being input to the decoders 65.

The ejection data latched in the latch circuits are input to the decoders 65. The decoders 65 decode the 2-bit ejection data into pulse selection data. Each decoder 65 of the present embodiment has a waveform selection table defining the relation between the ejection data and drive pulses. Based on the waveform selection table, pulse selection data are created. The pulse selection data are configured by making each bit correspond to each pulse forming the drive signal (COM). In the present embodiment, 4-bit pulse selection data are created. According to the content of each bit (e.g., "0" or "1"), supply or non-supply of a drive pulse to each piezoelectric actuator 25*a* is determined. The supply and control of the drive pulse will be described in detail later.

A timing signal from the control logic 66 is also applied to the decoders 65. This control logic 66 generates the timing signal based on the latch signal (LAT) or channel signal (CH). That is, the control logic 66 generates the timing signal in response to reception of the latch signal or channel signal. The decoders 65 serve also as a pulse selection data generator to deliver the pulse selection data when the timing signal is received.

In this case, the pulse selection data decoded by the decoders 65 are entered in turn to the level shifters 67 from the upper bit side upon the reception of the timing signal from the control logic 66. For example, at the first timing in the unit period (e.g., at the beginnings of periods t1, t1' shown in FIG. 7), the uppermost-bit data of the pulse selection data is entered into the level shifters 67. At the second timing (at the beginning of period t2), the second-bit data in the pulse selection data is entered into the level shifters 67. Data are input subsequently in the same manner. At the fourth timing (at the beginning of period t4 ), the lowest-bit data in the pulse selection data is entered into the level shifters 67. The level shifters 67 serve as a voltage amplifier. Where the pulse selection data is "1", a voltage capable of driving the switchers 68, e.g., an electrical signal boosted to the order of tens of volts, is output. The pulse selection data "1" boosted by the level shifters 67 is supplied to the switchers 68. The drive signal (COM) from the drive signal generator 57 are supplied to the input side of each switcher 68. The piezoelectric actuator 25*a* is connected with the output side of each switcher 68.

The pulse selection data controls the operation of the switchers 68, i.e., the supply of pulses to the piezoelectric actuators 25*a*. For example, during the period in which the pulse selection data applied to the switchers 68 is "1", the switchers 68 are activated so that the drive pulses are supplied to the piezoelectric actuators 25*a*. The potential level at the piezoelectric actuator 25*a* varies according to the drive pulses. On the other hand, during the period in which the pulse selection data applied to the switchers 68 is "0", the electrical signal for operating the switchers 68 is not output from the level shifters 67. Therefore, the switchers 68 are deactivated so that no drive pulse is supplied to the piezoelectric actuators 25*a*. Since the piezoelectric actuators 25*a* behave like capacitors, the potential immediately prior to the deactivation is held during the cutoff state of the switchers 68.

The decoders 65, control logic 66, level shifters 67, switchers 68, and controller 12 operating in this way serves as a pulse supplier to selectively supply the drive pulses to the piezoelectric actuators 25*a* from the drive signal COM based on the ejection data.

The drive signal COM generated by the drive signal generator 57 are next described.

Each of the drive signal COM of the present embodiment can be divided into a former half and a latter half based on the latch signal (LAT) as shown in FIG. 7. The former half is a leading drive subsignal PD1. The latter half is a trailing drive subsignal PD2. Each of these leading drive subsignal PD1 and trailing drive subsignal PD2 is generated during a time period associated with one-dot area (pixel).

These leading drive subsignal PD1 and trailing drive subsignal PD2 contain different pulses. That is, the leading drive subsignal PD1 consists of only three ejection pulses, i.e., a first medium ejection pulse MP1, a small ejection pulse SP, and a second medium ejection pulse MP2. The trailing drive subsignal PD2 consists of the above-described three ejection pulses SP, MP1, MP2, in addition to a vibrating pulse VP. In summary, the leading drive subsignal PD1 and trailing drive subsignal PD2 are different in terms of the presence or absence of the vibrating pulse VP. They are made uniform in the kinds of contained ejection pulses and order of generation.

The various pulses are hereinafter described. As mentioned previously, the leading drive subsignal PD1 and trailing drive subsignal PD2 differ only in terms of the presence or absence of the vibrating pulse VP. They contain pulses of the same kind. Therefore, the pulses contained in the trailing drive subsignal PD2 are described.

Figure 8:
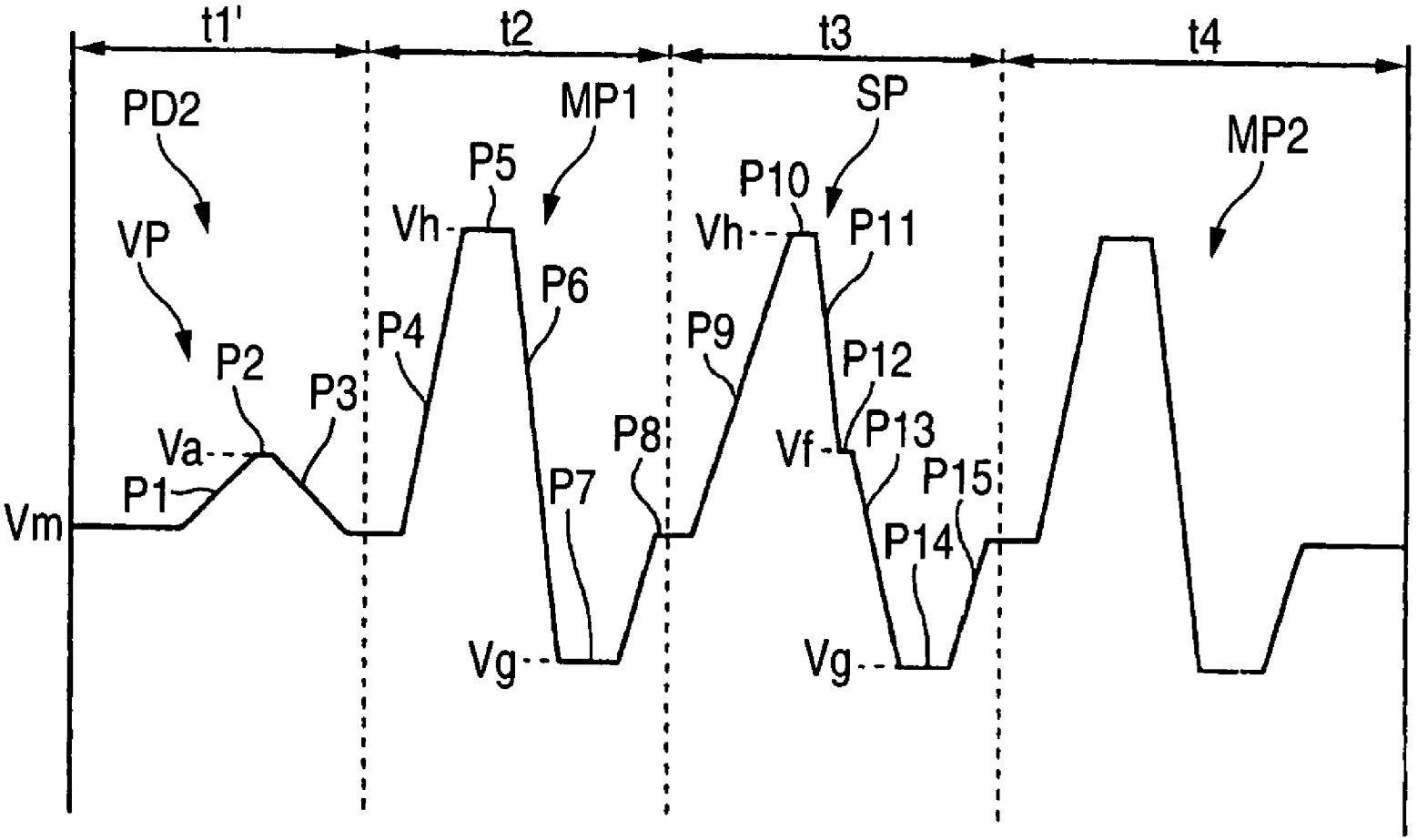
FIG. 8 is a diagram showing a trailing drive subsignal in the drive signal of FIG. 7.

First, the vibrating pulse VP is described. As shown in FIG. 8, the vibrating pulse VP is a trapezoidal pulse consisting of a decompression element P1, a hold element P2, and a compression element P3. The decompression element P1 is a waveform element for increasing the potential from an intermediate potential (reference potential) Vm to a vibration potential Va with a relatively gentle gradient that does not eject ink drops. When this decompression element P1 is supplied to the piezoelectric actuator 25*a*, the piezoelectric actuator 25*a* slightly shrinks in the longitudinal direction thereof and the volume of the pressure chamber 32 increases slightly. The hold element P2 is an element for holding the vibration potential Va. The shrunk state of the piezoelectric actuator 25*a* is maintained over the period in which the hold element P2 is supplied, so that the pressure chamber 32 maintains the previous expansion state. The compression element P3 is a waveform element for lowering the potential from the vibration potential Va to the intermediate potential Vm at a relatively gentle gradient that does not eject ink drops. When this compression element P3 is supplied to the piezoelectric actuator 25*a*, the actuator 25*a* extends slightly in the longitudinal direction thereof, and the volume of the pressure chamber 32 returns to the reference volume.

Then, the first medium ejection pulse MP1 and second medium ejection pulse MP2 are described. These medium ejection pulses MP1 and MP2 are pulses for ejecting a medium amount of ink drops (e.g., 7.5 pl). In the present embodiment, they are identical in waveform shape. That is, each is made up of a decompression element P4 for increasing the potential from the intermediate potential Vm to a maximum potential Vh at a constant gradient of an extent that does not eject ink drops, an expansion hold element P5 for maintaining the maximum potential Vh for a given time, an ejection element P6 for lowering the potential from the maximum potential Vh to a minimum potential Vg rapidly, a damping hold element P7 for maintaining the minimum potential Vg for a given time, and a damping decompression element P8 for increasing the potential from the minimum potential Vg to the intermediate potential Vm.

When the medium ejection pulses MP1 and MP2 are supplied to the piezoelectric actuator 25*a*, the piezoelectric actuator 25*a* and pressure chamber 32 operate as follows. That is, as the decompression element P4 is supplied, the piezoelectric actuator 25*a* shrinks greatly, and the pressure chamber 32 expands from its steady state to the maximum volume. Concomitantly with this expansion, the pressure inside the pressure chamber 32 is reduced, and the meniscus is pulled in toward the pressure chamber 32. The expansion state of the pressure chamber 32 is held over the supply period of the expansion hold element P5. The meniscus vibrates freely over this holding period.

Subsequently, the ejection element P6 is supplied, extending the piezoelectric actuator 25*a* greatly. The pressure chamber 32 is rapidly contracted to its minimum volume. Concomitantly with this contraction, pressure is applied to the ink inside the pressure chamber 32, ejecting an ink drop from the nozzle orifice 34. Subsequently to the ejection element P6, the damping hold element P7 is supplied, and the contracted state of the pressure chamber 32 is maintained. At this time, the meniscus is vibrating greatly under the influence of the ink drop ejection. Thereafter, the damping decompression element P8 is supplied at the timing that can cancel out vibrations of the meniscus. The pressure chamber 32 expands and returns to the reference state. That is, the pressure chamber 32 is expanded to cancel out the ink pressure inside the pressure chamber 32, thus reducing the ink pressure. In this way, the vibrations of the meniscus are damped.

Then, the small ejection pulse SP is described. This small ejection pulse SP is a pulse for ejecting a small amount of ink drops (e.g., 3.5 pl). The small ejection pulse SP of the present embodiment is composed of a decompression element P9 for increasing the potential from a minimum potential Vg to a maximum potential Vh at a relatively steep gradient, an expansion hold element P10 for maintaining the maximum potential Vh for a quite short time, an ejection element P11 for lowering the potential from the maximum potential Vh to an ejection potential Vf that is slightly lower than the maximum potential Vh at a steep gradient, an ejection hold element P12 for maintaining the ejection potential Vf for a quite short time, a damping compression element P13 for lowering the potential from the ejection potential Vf to the minimum potential Vg, a damping hold element P14 for maintaining the minimum potential Vg for a given time, and an damping decompression element P15 for increasing the potential from the minimum potential Vg to an intermediate potential Vm.

When this small ejection pulse SP is supplied to the piezoelectric actuator 25*a*, the piezoelectric actuator 25*a* and pressure chamber 32 operate as follows. That is, as the decompression element P9 is supplied, the piezoelectric actuator 25*a* shrinks greatly, and the pressure chamber 32 expands from the minimum volume to the maximum volume rapidly. Concomitantly with this expansion, the pressure inside the pressure chamber 32 is reduced greatly, and the meniscus is greatly pulled in toward the pressure chamber 32. At this time, the central portion of the meniscus, i.e., the vicinities of the center of each nozzle orifice 34, is once pulled in greatly. Then, it is brought to a convexly swollen state by the reaction.

Subsequently, the decompression hold element P10 and ejection element P11 are supplied in succession. As the ejection element P11 is supplied, the pressure chamber 32 contracts slightly, applying light pressure to the ink. The central portion of the meniscus is ejected as ink drops. Concomitantly with the ejection of the ink drops, the meniscus vibrates greatly. The volume of the pressure chamber 32 is varied by the subsequently supplied damping compression element P13, damping hold element P14, and damping decompression element P15. The vibrations of the meniscus are suppressed after the ejection of the ink drops.

In this trailing drive subsignal PD2, the vibrating pulse VP, first medium ejection pulse MP1, small ejection pulse SP, and second medium ejection pulse MP2 are generated in this order from the beginning of the latter half (trailing period) T2 of the unit period T. That is, in the period t1', the vibrating pulse VP is generated. In the period t2, the first medium ejection pulse MP1 is generated. Furthermore, in the period t3 , the small ejection pulse SP is generated. In the period t4 , the second medium ejection pulse MP2 is generated.

Meanwhile, the leading drive subsignal PD1 has no vibrating pulse VP. Therefore, as shown in FIG. 7, the first medium ejection pulse MP1, small ejection pulse SP, and second medium ejection pulse MP2 are generated in this order from the beginning of the former half (leading period) T1 of the unit period T. That is, in the period t2, the first medium ejection pulse MP1 is generated. In the period t3 , the small ejection pulse SP is generated. In the period t4 , the second medium ejection pulse MP2 is generated. In this leading drive subsignal PD1, the period t1 is set earlier than the period t2. This period t1 is a quite short period set to simplify the control as will be discussed later.

In comparing these leading drive subsignal PD1 and trailing drive subsignal PD2, the leading drive subsignal PD1 is shorter in duration by an amount corresponding to the absence of the vibrating pulse VP. In particular, the generation period of the leading drive subsignal PD1 is from the rising edge of the first latch signal (LAT) to the trailing end of the second medium ejection pulse MP2 (trailing end of the damping decompression element P8). The generation period of the trailing drive subsignal PD2 is from the rising edge of the second latch signal to the trailing end of the second medium ejection pulse MP2. According to the drive signal COM configured so as to contain the leading drive subsignal PD1 and trailing drive subsignal PD2, the signal generation period (duration) can be made as short as possible while containing necessary vibration. As a result, high-frequency ejection of ink drops can be attained.

Furthermore, since the number of the vibrating operation performed during one cycle of the drive signal can be reduced, the power consumption can be also reduced.

Furthermore, in the present embodiment, the signal containing the vibrating pulse VP is generated in the latter half of the signal generation period, while the signal containing no vibrating pulse VP is generated in the former half of the signal generation period. That is, the vibrating operation is performed on the way of the signal generation period to enhance the effect of the vibrating operation.

Specifically, since the vibrating pulse VP is generated at the beginning of the divided unit period, if it is generated in the former half of the signal generation period, vibration cannot be generated until the next signal generation period arrives. Consequently, the meniscus will be left unchanged over a long time period. Furthermore, in the beginning of the signal generation period, it is unlikely that the viscosity of the ink is not increased due to the ejection of ink drops in the immediately preceding period.

Accordingly, where a configuration in which the signal not having the vibrating pulse VP is generated earlier than the signal having the vibrating pulse VP as in the present embodiment, a vibrating operation is conducted on the way of the signal generation period. Increase in the viscosity of the ink near the noble orifices 34 can be prevented efficiently.

It is preferable from this point of view that the vibrating pulse VP be generated at timing close to the midpoint of the signal generation period, because the time from the end of the immediately preceding signal generation period to the generation timing of the vibrating pulse VP is made equal to the time from the generation timing of the vibrating pulse VP to the beginning of the next signal generation period. This reduces variation between the vibrating pulses VP generated one after another in time for which the meniscus is left intact. The effect of the vibrations can be enhanced further.

Incidentally, the drive signal COM is generated when the drive signal generator 57 receives the trigger signal (PTS). This trigger signal is generated by multiplying the encoder output from the linear encoder 11 by the controller 12 as described above. Therefore, there is an anxiety that the trigger signals are generated with a completely fixed interval. If the duration of the signal generation period of the drive signal is determined without taking account of the interval variations among the trigger signals, there is an anxiety that the generation of the drive signal COM is not complete at the instant when the next trigger signal is received.

In view of this, in the present embodiment, the duration of the drive signal COM (signal generation period) is set to less than the minimum value of the interval T of the trigger signal PTS. In this case, for example, the variation in the interval T is obtained based on the fabrication accuracy of the scale 41. Specifically, it is calculated from the dimensional tolerance of the pitch at which the stripes 41*a* are formed. Alternatively, the minimum value of the interval may be obtained from the encoder output which is obtained by actually detecting the pitch of the formation of the stripes 41*a* by the photo interrupter 42.

If the duration of the drive signal COM is set to less than the minimum value of the interval of the trigger signal PTS, the reliability of the printer can be enhanced, because the generation of the drive signal COM certainly has completed at the reception of the next trigger signal.

Similarly, in the present embodiment, with respect to the leading drive subsignal PD1 and trailing drive subsignal PD2, their durations are defined, taking account of the variation between the intervals T1 and T2 of the successive latch signals (LAT). That is, the duration of each of the drive subsignals PD1 and PD2 is set to less than the minimum value of the variable intervals of the latch signals. Because of this configuration, the generation of each drive subsignal has ended at the generation timing of the next arriving latch signal. Therefore, it is possible to avoid the problem that the next latch signal is received during the generation of the drive subsignal. The reliability of the printer can be enhanced.

Then, the recording control by the printer of the above configuration is described. As shown in FIG. 7, in the present embodiment, the leading drive subsignal PD1 is composed of three ejection pulses SP, MP1, and MP2. The trailing drive subsignal PD2 is composed of three ejection pulses SP, MP1, MP2, and one vibrating pulse VP. With respect to the pulse selection data, it suffices to assign one to one pulse. Therefore, 3 bits of pulse selection data corresponding to the leading drive subsignal PD1 should suffice actually. However, in the present embodiment, pulse selection data is composed of 4 bits even in the leading drive subsignal PD1. In other words, dummy pulse selection data is provided prior to the first medium ejection pulse MP1. Control is provided based on this pulse selection data, using a dummy channel signal CH' (i.e., dummy selection timing signal).

This configuration is adopted for the following reason. The pulse selection data corresponding to the leading drive subsignal PD1 and the pulse selection data corresponding to the trailing drive subsignal PD2 are made uniform in number of bits. As described above, the decoders 65 decode the ejection data into the pulse selection data. At this time, if the pulse selection data corresponding to the leading drive subsignal PD1 and the pulse selection data corresponding to the trailing drive subsignal PD2 are different in number of bits of data, it becomes necessary for the decoders 65 to recognize whether the ejection data is come from the leading drive subsignal PD1 or the trailing drive subsignal PD2 to perform the decoding. In an apparatus that is required to process translations at high speed such as a printer, such a recognition operation introduces a delay of the processing and so it is desired to minimize the operation. If the pulse selection data for the leading drive subsignal PD1 and the pulse selection data for the trailing drive subsignal PD2 are made uniform in number of bits, the decoders 65 are only required to decode the latched ejection data. Therefore, the decoding operation can be simplified. Increased processing speed can be accomplished.

By making the pulse selection data uniform in number of bits in this way, data (in this example, the most significant bit) for the vibrating pulse VP in the pulse selection data for the leading drive subsignal PD1 becomes surplus. It is necessary to invalidate the surplus data because it is impossible to perform matching between the pulse selection data and the selected pulse. In the present embodiment, this invalidation is attained by providing the dummy channel signal CH'.

More specifically, in the former half T1 of the generation period of the drive signal COM, the dummy channel signal CH' is output immediately after the generation of the LAT signal and during the period when the drive signal COM is at the intermediate potential Vm. Because of this configuration, in the gradation information "00" associated with the vibrating operation, the switchers 68 are activated during the period t1 from the generation timing of the latch signal to the generation timing CH' of the dummy channel signal. The drive signal COM is supplied to the piezoelectric actuator 25*a*. However, during this interval t1, the drive signal COM is at the intermediate potential Vm and constant. Moreover, this intermediate potential Vm and the terminal potential of each pulse are equipotential. Consequently, the piezoelectric actuator 25*a* maintain the state assumed up to this time. Accordingly, the pulse selection data can be invalidated without hindrance.

If this piezoelectric actuator 25*a* is used for a long time or used under high humidity environment, there is an anxiety that the potential is reduced by spontaneous discharge. Where the configuration in which the intermediate potential Vm is supplied to the piezoelectric actuator 25*a* using a dummy channel signal as in the present embodiment is adopted, the potential is returned to the intermediate potential Vm even if the actuator potential has been decreased by spontaneous discharge. Therefore, in supplying the ejection pulses and vibrating pulse VP, these pulses can be supplied smoothly (i.e., while reducing the potential gap). As a result, wrong ejection of ink drops or other problem can be prevented.

The gradation control in this printer is described. In this printer, recording corresponding to two dots is made by one cycle of the drive signal COM. Each dot is recorded with four gradation levels. Therefore, two latch signals (LAT) are generated for one trigger signal (PTS). Furthermore, as described previously, control in one unit period is provided using 4-bit pulse selection data and so three channel signals are generated within a period corresponding to the one-dot recording. Each decoder 65 generates the most significant bit of the pulse selection data at the receive timing of the latch signal, and generates the second bit in the pulse selection data at the receive timing of the first channel signal. Similarly, the decoder 65 generates the third bit in the pulse selection data at the receive timing of the second channel signal, and generates the least significant bit in the pulse selection data at the receive timing of the third channel signal.

The decoder 65 creates 4-bit pulse selection information by decoding the ejection data. In particular, the decoder 65 creates pulse selection data "1000" by decoding the gradation information "00" associated with the non-ejection, and creates pulse selection data "0010" by decoding the gradation information "01" associated with the small-dot recording. Furthermore, it creates pulse selection data "0100" by decoding the gradation information "10" associated with the medium-dot recording, and creates pulse selection data "0101" by decoding the gradation information "11" associated with the large-dot recording.

Figure 9:
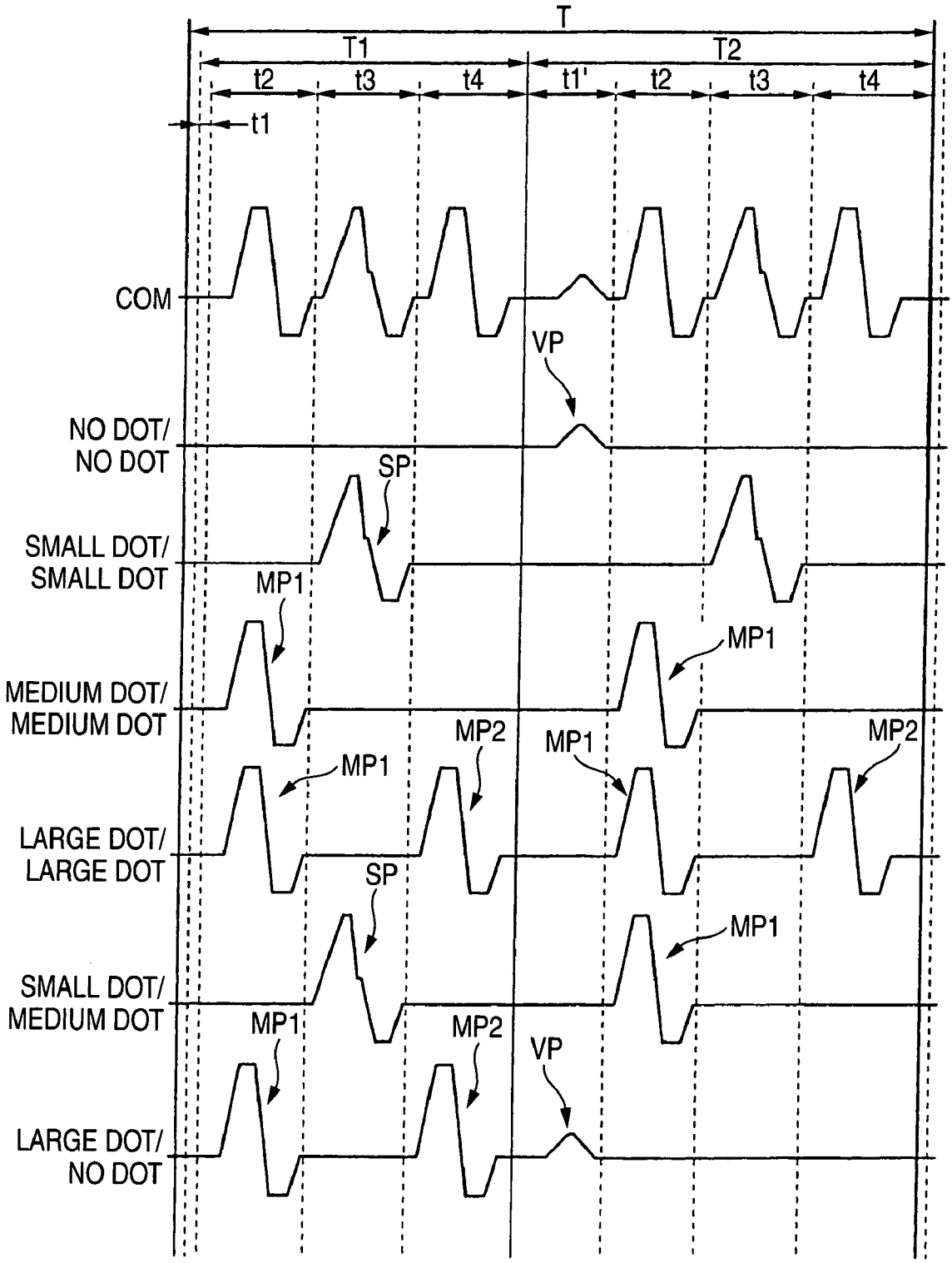
FIG. 9 is a diagram showing how to control the recording head.
Figure 10:
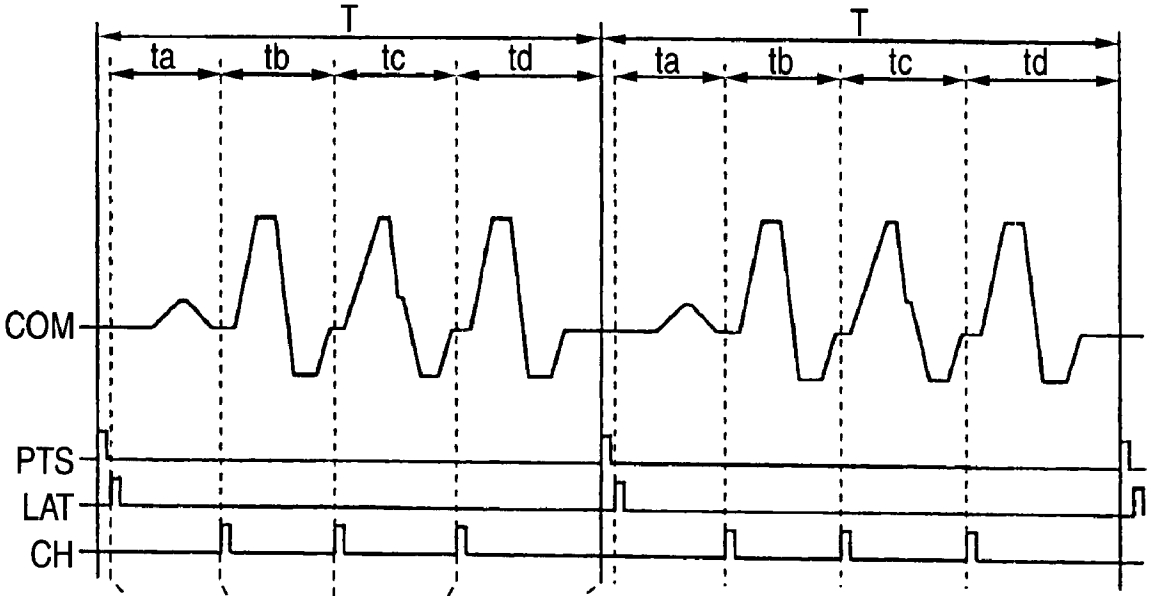
FIG. 10 is a diagram showing a drive signal for driving a related-art recording head.

Consequently, control of ejection of ink drops as exemplified in FIG. 9 is provided. That is, in the leading half of the unit period, the switchers 68 are activated in the period t1 by the gradation information "00" As described above, the intermediate potential Vm is supplied to the piezoelectric actuator 25*a*. Note that the supply of the intermediate potential Vm does not eject ink drops. The switchers 68 are activated in period t3 by the gradation information "01". The small ejection pulse SP is supplied to the piezoelectric actuator 25*a*, so that a small ink drop is ejected. The switchers 68 are activated in period t2 by the gradation information "10". The first medium ejection pulse MP1 is supplied to the piezoelectric actuator 25*a*, so that a medium ink drop is ejected. The switchers 68 are activated in periods t2 and t4 by the gradation information "11". The first medium ejection pulse MP1 and second medium ejection pulse MP2 are supplied to the piezoelectric actuator 25*a* in this order, so that two medium ink drops are ejected in succession.

In the trailing half of the unit period, the switchers 68 are activated in period t1' by gradation information "00". The vibrating pulse VP is supplied to the piezoelectric actuator 25*a*. With other recording gradations, the same operation is performed as in the former half of the unit period. Briefly, a small ink drop is ejected by gradation information "01"; one medium ink drop is ejected by gradation information "10"; and two medium ink drops are ejected in succession by gradation information "11".

The present invention is not limited to the above embodiment. Various modifications are possible within the scope of the appended claims. For example, in the above embodiments, an example is taken in which two (N=2) drive subsignals are contained within one cycle of the drive signal. However, three or more (N≧3) drive subsignals may be contained within one cycle of the drive signal.

Furthermore, the degree of viscosity increase of the ink (liquid) varies according to the kind of ink (liquid). Therefore, the number (N) of drive subsignals contained in one cycle of the drive signal may be made different according to the kind of the ejected ink. One of the drive subsignals may be taken as a drive subsignal having the vibrating pulse VP. The other drive subsignal may be taken as the drive subsignal not having the vibrating pulse VP.

For example, in a pigment ink having a solvent that evaporates more easily than dye inks and increases in viscosity more easily, two drive subsignals are contained within one cycle of the drive signal as in the above embodiments. On the other hand, in dye inks that increase in viscosity less easily, 6 to 8, for example, drive subsignals are contained within cycle of the drive signal. Because of this configuration, the execution frequency of the vibration becomes 1/N of one cycle of the drive signal. A necessary and sufficient amount of vibration is given for the kind of the ejected ink. At the same time, the duration of the drive signal COM can be made as small as possible.

Where the effect of the vibration is taken into consideration, N is a number that is finite and can sustain the effect of vibration. It is experimentally confirmed that in a liquid that cannot be easily increased in viscosity, the number can be set up to about N=16.

In addition, the ejection pulses are not limited to the above-described waveforms. Rather, various ejection pulses can be used. For example, all ejection pulses within one recording period may be made identical in shape. Specifically, ejection pulses are made of small ejection pulses SP capable of ejecting a small amount of liquid drops. In this case, plural small ejection pulses SP generated at regular intervals and the vibrating pulse VP are contained in the trailing drive subsignal PD2, while only plural small ejection pulses SP generated at regular intervals are contained in the leading drive subsignal PD1.

Furthermore, the pressure generating element is not limited to the above-described piezoelectric actuator 25*a*. For example, it may be a piezoelectric actuator of the flexure actuation mode, a magnetostrictive element, an electrostatic actuator, and so on.

The present invention can also be applied to a liquid ejection apparatus other than printers. For example, the invention can also be applied to display fabrication equipment for fabricating color filters for liquid crystal displays and so on, electrode fabrication equipment for forming electrodes such as for organic electroluminescent displays and FEDs (field emission displays), chip fabrication equipment for fabricating biochips (biochemical devices), and liquid ejection apparatus such as a micropipette for supplying an accurate, trace amount of sample solution.

What is claimed is:

1. A liquid ejection apparatus, comprising:

a liquid ejection head, comprising:

a nozzle orifice communicated with a pressure chamber; and a pressure generating element, which generates pressure fluctuation in liquid which is contained in the pressure chamber;

a drive signal generator, which generates a drive signal containing, within one cycle thereof:

a first drive subsignal, containing a plurality of first drive pulses each of which drives the pressure generating element to generate the pressure fluctuation so as to eject the liquid from the nozzle orifice, and a second drive pulse which drives the pressure generating element to generate the pressure fluctuation so as not to eject the liquid from the nozzle orifice; and at least one second drive subsignal, containing the first drive pulses without containing the second drive pulse; and a pulse supplier, which selectively supplies at least one of the first drive pulses and the second drive pulse to the pressure generating element, in accordance with an amount of the liquid to be ejected from the nozzle orifice, wherein the first drive subsignal is associated with a first minimum area subjected to the liquid ejection;

wherein the second drive subsignal is associated with a second minimum area subjected to the liquid ejection, which is different from the first minimum area; and wherein a duration of the second drive subsignal is shorter than a duration of the first drive subsignal.

2. The liquid ejection apparatus as set forth in claim 1, wherein all of the first drive pulses have an identical waveform.

3. The liquid ejection apparatus as set forth in claim 1, wherein the second drive subsignal is arranged at the beginning of the one cycle of the drive signal.

4. The liquid ejection apparatus as set forth in claim 1, wherein:

each of the first drive pulses and the second pulse is designated by one of pulse selection data processed in the pulse supplier; and the number of the pulse selection data for the first drive subsignal and the number of the pulse selection data for the second drive subsignal are the same, so that a predetermined potential of the second drive subsignal is supplied to the pressure generating element by one of the pulse selection data for the second drive subsignal.

5. The liquid ejection apparatus as set forth in claim 1, wherein:

the drive signal is repetitively generated in accordance with a series of first timing signals which are generated in the external of the drive signal generator; and a duration of the one cycle of the drive signal is less than an interval of the first timing signals.

6. The liquid ejection apparatus as set forth in claim 5, wherein:

the minimum area is repetitively defined in accordance with a series of second timing signals which are generated in the external of the drive signal generator; and a duration of each of the first drive subsignal and the second drive subsignal is less than an interval of the second timing signals.

7. The liquid ejection apparatus as set forth in claim 1, wherein the first drive pulses includes a pair of first ejection pulses each for ejecting a liquid droplet having a first volume, and a second ejection pulse generated between the first ejection pulses for ejecting a liquid droplet having a second volume less than the first volume.

8. The liquid ejection apparatus as set forth in claim 1, wherein the first drive pulses are generated at a fixed interval each for ejecting a liquid droplet having a fixed volume.

9. The liquid ejection apparatus as set forth in claim 1, wherein the drive signal generator repetitively generates the drive signal such that the first drive subsignal and the second drive subsignal are alternately generated.

10. The liquid ejecting apparatus as set forth in claim 1, wherein the second drive pulse is prior to or subsequent to the plurality of first drive pulses in the first drive subsignal, and the plurality of first drive pulses contained in the first drive sub signal are identical with the plurality of first drive pulses contained in the second drive subsignal.

11. A method of controlling a liquid ejection apparatus which comprises a liquid ejection head provided with: a nozzle orifice communicated with a pressure chamber; and a pressure generating element, which generates pressure fluctuation in liquid which is contained in the pressure chamber, the method comprising steps of:

generating a drive signal containing, within one cycle thereof:

a first drive subsignal, containing a plurality of first drive pulses each of which drives the pressure generating element to generate the pressure fluctuation so as to eject the liquid from the nozzle orifice, and a second drive pulse which drives the pressure generating element to generate the pressure fluctuation so as not to eject the liquid from the nozzle orifice; and at least one second drive subsignal, containing the first drive pulses without containing the second drive pulse; and supplying selectively at least one of the first drive pulses and the second drive pulse to the pressure generating element, in accordance with an amount of the liquid to be ejected from the nozzle orifice, wherein the first drive subsignal isassociated with a first minimum area subjected to the liquid ejection;

wherein the second drive subsignal is associated with a second minimum area subjected to the liquid ejection, which is different from the first minimum area; and wherein a duration of the second drive subsignal is shorter than a duration of the first drive subsignal.

12. The method as set forth in claim 11, wherein the drive signal is repetitively generated such that the first drive subsignal and the second drive subsignal are alternately generated.

13. The method as set forth in claim 11, wherein the second drive pulse is prior to or subsequent to the plurality of first drive pulses in the first drive subsignal, and the plurality of first drive pulses contained in the first drive subsignal are identical with the plurality of first drive pulses contained in the second drive subsignal.

* * * * *